US006539171B2

(12) United States Patent
VonArx et al.

(10) Patent No.: US 6,539,171 B2
(45) Date of Patent: Mar. 25, 2003

(54) FLEXIBLE SPIRALLY SHAPED HEATING ELEMENT

(75) Inventors: Theodore VonArx, La Crescent, MN (US); Clifford D. Tweedy, St. Charles, MO (US); Keith Laken, Winona, MN (US); David Adank, Fountain City, WI (US)

(73) Assignee: Watlow Polymer Technologies, Winona, MN (US)

( * ) Notice: Subject to any disclaimer, the term of this patent is extended or adjusted under 35 U.S.C. 154(b) by 25 days.

(21) Appl. No.: 09/756,162

(22) Filed: Jan. 8, 2001

(65) Prior Publication Data

US 2002/0090209 A1 Jul. 11, 2002

(51) Int. Cl.[7] ..... F24H 1/18; H05B 3/78

(52) U.S. Cl. ..... 392/451; 392/450; 392/497; 219/487

(58) Field of Search ..... 392/450, 451, 392/497; 338/282, 264, 265, 286, 296–302, 316; 219/481, 523, 552

(56) References Cited

U.S. PATENT DOCUMENTS

| | | | | |
|---|---|---|---|---|
| 1,042,922 | A | 11/1912 | Gold | 219/523 |
| 1,046,465 | A | 12/1912 | Hoyt | |
| 1,058,270 | A | 4/1913 | Stephens | 219/217 |

(List continued on next page.)

FOREIGN PATENT DOCUMENTS

| | | |
|---|---|---|
| DE | 35 12 659 A | 9/1986 |
| DE | 3512659 | 10/1986 |
| DE | 38 36 387 C1 | 5/1990 |
| GB | 14562 | 9/1913 |
| GB | 1070849 | 6/1967 |
| GB | 1325084 | 8/1973 |
| GB | 1498792 | 1/1978 |
| GB | 2244898 | 12/1999 |
| JP | 53-134245 | 11/1978 |
| JP | 3-129694 | 6/1991 |
| JP | 07 211438 A | 11/1995 |

OTHER PUBLICATIONS

"Polymers", *Guide to Selecting Engineered Materials*, a special issue of *Advanced Materials & Processes*, Metals Park, OH ASM International, 1989, pp. 92–93.

"Makroblend Polycarbonate Blend, Tedur Polyphenylene Sulfide", *Machine Design: Basics of Design Engineering*, Cleveland, OH, Penton Publishing, Inc., Jun. 1991, pp. 820–821, 863, 866–867.

European Search Report, Jul. 13, 1998.

"At HEI, Engineering is our Middle Name", Heaters Engineering, Inc., Mar. 2, 1995.

(List continued on next page.)

*Primary Examiner*—Teresa Walberg
*Assistant Examiner*—Thor Campbell
(74) *Attorney, Agent, or Firm*—Duane Morris LLP

(57) ABSTRACT

The present invention provides heating elements and methods for their fabrication and use. The heating elements of this invention include a spirally shaped structure having a plurality of spiral forms, and may contain a thermally conductive, electrically insulated polymeric coating, such as a fluorocarbon resinous coating of about 0.001–0.020 in. in thickness. The preferred spirally shaped heating elements of this invention provide a lower, preferably substantially lower, flux or watt density than that for a Tubular Heating Element of substantially similar Active Element Volume ($in^3$), wherein said spirally shaped heating element has the same or greater overall wattage rating (total watts) than the Tubular Heating Element. The heating elements of this invention preferably have an Effective Relative Heated Surface Area of about 5–60 $in^2/in^3$, with a target range of about 20–30 $in^2/in^3$, but can generate a heat flux of about 10–50 $w/in^2$.

12 Claims, 1 Drawing Sheet

U.S. PATENT DOCUMENTS

| | | | | | |
|---|---|---|---|---|---|
| 1,281,157 | A | | 10/1918 | Hadaway, Jr. | |
| 1,477,602 | A | | 12/1923 | Simon | |
| 1,674,488 | A | | 6/1928 | Tang | |
| 1,987,119 | A | | 1/1935 | Long | 219/39 |
| 1,992,593 | A | | 2/1935 | Whitney | 219/46 |
| 2,146,402 | A | | 2/1939 | Morgan | 219/523 |
| 2,202,095 | A | | 5/1940 | Delhaye et al. | 219/217 |
| 2,274,445 | A | | 2/1942 | Greer | 219/38 |
| 2,357,906 | A | * | 9/1944 | Osterheld | 174/126.1 |
| 2,426,976 | A | | 9/1947 | Taulman | 219/19 |
| 2,456,343 | A | | 12/1948 | Tuttle | 201/67 |
| 2,464,052 | A | | 3/1949 | Numrich | 219/38 |
| 2,593,087 | A | | 4/1952 | Baggett | 219/217 |
| 2,593,459 | A | | 4/1952 | Johnson | 219/39 |
| 2,710,909 | A | | 6/1955 | Logan et al. | 219/46 |
| 2,719,907 | A | | 10/1955 | Combs | 219/46 |
| 2,804,533 | A | | 8/1957 | Nathanson | 219/522 |
| 2,889,439 | A | | 6/1959 | Musgrave | 219/19 |
| 2,938,992 | A | | 5/1960 | Crump | 219/46 |
| 3,061,501 | A | | 10/1962 | Dittman et al. | 156/250 |
| 3,173,419 | A | | 3/1965 | Dubilier et al. | 128/399 |
| 3,191,005 | A | | 6/1965 | Cox | 219/528 |
| 3,201,738 | A | | 8/1965 | Mitoff | 338/238 |
| 3,211,203 | A | | 10/1965 | Creed et al. | 146/81 |
| 3,238,489 | A | | 3/1966 | Hay | 388/250 |
| 3,268,846 | A | | 8/1966 | Morey | 338/212 |
| 3,296,415 | A | | 1/1967 | Eisler | 219/385 |
| 3,352,999 | A | | 11/1967 | Macoicz et al. | 219/321 |
| 3,374,338 | A | | 3/1968 | Morey | 219/529 |
| 3,385,959 | A | | 5/1968 | Ames et al. | |
| 3,496,517 | A | | 2/1970 | Walter | 339/18 |
| 3,564,589 | A | | 2/1971 | Arak | 219/331 |
| 3,573,430 | A | | 4/1971 | Eisler | 219/385 |
| 3,596,257 | A | * | 7/1971 | Arntz et al. | 219/411 |
| 3,597,591 | A | | 8/1971 | Van Derlip | 219/528 |
| 3,614,386 | A | | 10/1971 | Hepplewhite | 219/312 |
| 3,621,566 | A | | 11/1971 | Welsh | 29/610 |
| 3,623,471 | A | | 11/1971 | Bogue et al. | 126/263.01 |
| 3,648,659 | A | | 3/1972 | Jones | 119/1 |
| 3,657,516 | A | | 4/1972 | Fujihara | 219/345 |
| 3,657,517 | A | | 4/1972 | Hoyt | 219/535 |
| D224,406 | S | | 7/1972 | Heck | D26/1 |
| 3,678,248 | A | | 7/1972 | Ticault et al. | 219/525 |
| 3,683,361 | A | | 8/1972 | Salzwedel | 338/322 |
| 3,686,472 | A | | 8/1972 | Harris | 219/213 |
| 3,707,618 | A | | 12/1972 | Zeitlin et al. | 219/336 |
| 3,725,645 | A | | 4/1973 | Shevlin | 219/521 |
| 3,781,526 | A | | 12/1973 | Damron | 219/538 |
| 3,831,129 | A | | 8/1974 | Frey | 339/19 |
| 3,860,787 | A | | 1/1975 | Strobach | 219/336 |
| 3,878,362 | A | | 4/1975 | Stinger | 219/528 |
| 3,888,711 | A | | 6/1975 | Breitner | 156/93 |
| 3,908,749 | A | | 9/1975 | Williams | 165/2 |
| 3,927,300 | A | | 12/1975 | Wada et al. | 219/381 |
| 3,933,550 | A | | 1/1976 | Erwin | 156/85 |
| 3,943,328 | A | | 3/1976 | Cunningham | 219/335 |
| 3,952,182 | A | | 4/1976 | Flanders | 219/309 |
| 3,968,348 | A | | 7/1976 | Stanfield | 219/535 |
| 3,974,358 | A | | 8/1976 | Goltsos | 219/387 |
| 3,976,855 | A | | 8/1976 | Altmann et al. | 219/532 |
| 3,985,928 | A | | 10/1976 | Watanabe et al. | 428/273 |
| 3,987,275 | A | | 10/1976 | Hurko | 219/461 |
| 4,021,642 | A | | 5/1977 | Fields, Jr. | 219/391 |
| 4,038,519 | A | | 7/1977 | Foucras | 219/301 |
| 4,046,989 | A | | 9/1977 | Parise et al. | 219/437 |
| 4,058,702 | A | | 11/1977 | Jerles | 219/321 |
| 4,068,115 | A | | 1/1978 | Mack et al. | 219/386 |
| 4,083,355 | A | | 4/1978 | Schwank | 126/39 J |
| 4,094,297 | A | | 6/1978 | Ballentine | 126/39 J |
| 4,102,256 | A | | 7/1978 | John et al. | 99/372 |
| 4,112,410 | A | | 9/1978 | Wrob et al. | 338/243 |
| 4,117,311 | A | | 9/1978 | Sturm | 219/544 |
| 4,119,834 | A | | 10/1978 | Losch | 392/418 |
| 4,152,578 | A | | 5/1979 | Jacons | 219/336 |
| 4,158,078 | A | | 6/1979 | Egger et al. | 428/102 |
| 4,176,274 | A | | 11/1979 | Lippera | 219/522 |
| 4,186,294 | A | | 1/1980 | Bender | 219/527 |
| 4,201,184 | A | | 5/1980 | Scheidler et al. | 126/39 J |
| 4,217,483 | A | | 8/1980 | Vogel et al. | 219/541 |
| 4,224,505 | A | | 9/1980 | Sturm | 219/544 |
| 4,233,495 | A | | 11/1980 | Scoville et al. | 219/386 |
| 4,245,149 | A | | 1/1981 | Fairlie | 219/528 |
| 4,272,673 | A | | 6/1981 | Semanaz et al. | 219/544 |
| 4,294,643 | A | | 10/1981 | Tadewald | 156/293 |
| 4,296,311 | A | | 10/1981 | Hagglund et al. | 219/464 |
| 4,304,987 | A | | 12/1981 | van Konynenburg | 219/553 |
| 4,313,053 | A | | 1/1982 | Sturm | 219/544 |
| 4,313,777 | A | | 2/1982 | Buckley et al. | 156/272 |
| 4,321,296 | A | | 3/1982 | Rougier | 428/212 |
| 4,326,121 | A | | 4/1982 | Welsby et al. | 219/523 |
| 4,334,146 | A | | 6/1982 | Sturm | 219/492 |
| 4,337,182 | A | | 6/1982 | Needham | 524/609 |
| 4,346,277 | A | | 8/1982 | Wojtecki et al. | 219/528 |
| 4,346,287 | A | | 8/1982 | Desloge | 219/541 |
| 4,349,219 | A | | 9/1982 | Sturm | 285/21 |
| 4,354,096 | A | | 10/1982 | Dumas | 219/523 |
| 4,358,552 | A | | 11/1982 | Shinohara et al. | 523/443 |
| 4,364,308 | A | | 12/1982 | John et al. | 99/351 |
| 4,375,591 | A | | 3/1983 | Sturm | 219/544 |
| 4,387,293 | A | | 6/1983 | Grice et al. | 219/529 |
| 4,388,607 | A | | 6/1983 | Toy et al. | 338/22 SD |
| 4,390,551 | A | | 6/1983 | Swartley et al. | 426/107 |
| 4,419,567 | A | | 12/1983 | Murphy et al. | 219/336 |
| 4,429,215 | A | | 1/1984 | Sakai et al. | 219/528 |
| 4,436,988 | A | | 3/1984 | Blumenkranz | 219/544 |
| 4,482,239 | A | | 11/1984 | Hosono et al. | 355/3 |
| 4,493,985 | A | | 1/1985 | Keller | 219/535 |
| 4,501,951 | A | | 2/1985 | Benin et al. | 219/243 |
| 4,530,521 | A | | 7/1985 | Nyffeler | 285/21 |
| 4,540,479 | A | | 9/1985 | Sakurai et al. | 204/427 |
| 4,606,787 | A | | 8/1986 | Pelligrino | 156/632 |
| 4,633,063 | A | | 12/1986 | Willis | 219/243 |
| 4,640,226 | A | | 2/1987 | Liff | 119/1 |
| 4,641,012 | A | | 2/1987 | Roberts | 219/331 |
| 4,658,121 | A | | 4/1987 | Horsma et al. | 219/553 |
| 4,687,905 | A | | 8/1987 | Cunningham et al. | 219/336 |
| 4,703,150 | A | | 10/1987 | Kunnecke et al. | 219/535 |
| 4,707,590 | A | | 11/1987 | Lefebvre | 219/523 |
| 4,725,717 | A | | 2/1988 | Harrison | 219/528 |
| 4,730,148 | A | | 3/1988 | Nakata | 315/397 |
| 4,751,528 | A | | 6/1988 | Spehrley, Jr. et al. | 346/140 |
| 4,756,781 | A | | 7/1988 | Etheridge | 156/85 |
| 4,762,980 | A | | 8/1988 | Insley | 219/307 |
| 4,784,054 | A | | 11/1988 | Karos et al. | 99/483 |
| 4,797,537 | A | | 1/1989 | Berthelius et al. | 219/528 |
| 4,845,343 | A | | 7/1989 | Aune et al. | 219/545 |
| 4,860,434 | A | | 8/1989 | Louison et al. | 29/611 |
| 4,865,014 | A | | 9/1989 | Nelson | 126/361 |
| 4,865,674 | A | | 9/1989 | Durkin | 156/158 |
| 4,866,252 | A | | 9/1989 | Van Loo et al. | 219/535 |
| 4,904,845 | A | | 2/1990 | Wonka | 219/280 |
| 4,913,666 | A | | 4/1990 | Murphy | 439/709 |
| 4,927,999 | A | | 5/1990 | Hanselka | 219/535 |
| 4,948,948 | A | | 8/1990 | Lesage | 219/329 |
| 4,956,138 | A | | 9/1990 | Barfield | 264/129 |
| 4,970,528 | A | | 11/1990 | Beaufort et al. | 346/25 |
| 4,972,197 | A | | 11/1990 | McCauley et al. | 343/704 |
| 4,982,064 | A | | 1/1991 | Hartman et al. | 219/727 |
| 4,983,814 | A | | 1/1991 | Ohgushi et al. | 219/545 |
| 4,986,870 | A | | 1/1991 | Frohlich | 156/382 |
| 4,993,401 | A | | 2/1991 | Diekmann et al. | 126/39 |

| | | | | |
|---|---|---|---|---|
| 5,003,693 | A | 4/1991 | Atkinson et al. | 29/849 |
| 5,013,890 | A | 5/1991 | Gamble | 392/497 |
| 5,021,805 | A | 6/1991 | Imaizumi et al. | 346/76 R |
| 5,023,433 | A | 6/1991 | Gordon | 219/548 |
| 5,038,458 | A | 8/1991 | Wagoner et al. | 29/593 |
| 5,041,846 | A | 8/1991 | Vincent et al. | 346/25 |
| 5,051,275 | A | 9/1991 | Wong | 427/58 |
| 5,066,852 | A | 11/1991 | Willbanks | 219/544 |
| 5,068,518 | A | 11/1991 | Yasuda | 219/549 |
| 5,111,025 | A | 5/1992 | Barma et al. | 29/217 |
| 5,113,480 | A | 5/1992 | Murphy et al. | 392/501 |
| 5,129,033 | A | 7/1992 | Ferrara et al. | 392/447 |
| 5,136,143 | A | 8/1992 | Kutner et al. | 219/544 |
| 5,155,800 | A | 10/1992 | Rezabek et al. | 382/503 |
| 5,162,634 | A | 11/1992 | Kusaka | 219/216 |
| 5,184,969 | A | 2/1993 | Sharpless et al. | 445/24 |
| 5,208,080 | A | 5/1993 | Gajewski et al. | 428/1 |
| 5,221,419 | A | 6/1993 | Beckett | 156/630 |
| 5,221,810 | A | 6/1993 | Spahn | 102/475 |
| 5,237,155 | A | 8/1993 | Hill | 219/544 |
| 5,252,157 | A | 10/1993 | Inhofe, Jr. | 156/158 |
| 5,255,595 | A | 10/1993 | Higgins | 99/378 |
| 5,255,942 | A | 10/1993 | Kenworthy | 285/21 |
| 5,287,123 | A | 2/1994 | Medin et al. | 346/140 R |
| 5,293,446 | A | 3/1994 | Owens et al. | 392/449 |
| 5,300,760 | A | 4/1994 | Batliwalla et al. | 219/549 |
| 5,302,807 | A | 4/1994 | Zhao | 219/211 |
| 5,304,778 | A | 4/1994 | Dasgupta et al. | 219/270 |
| 5,313,034 | A | 5/1994 | Grimm | 156/274.2 |
| 5,389,187 | A | 2/1995 | Jacaruso et al. | 156/378 |
| 5,397,873 | A | 3/1995 | Stoops et al. | 219/450 |
| 5,406,316 | A | 4/1995 | Schwiebert et al. | 347/18 |
| 5,406,321 | A | 4/1995 | Schwiebert et al. | 347/102 |
| 5,408,070 | A | 4/1995 | Hyllberg | 392/503 |
| 5,453,599 | A | 9/1995 | Hall, Jr. | 219/544 |
| 5,461,408 | A | 10/1995 | Giles et al. | 347/102 |
| 5,476,562 | A | 12/1995 | Inhofe, Jr. | 156/156 |
| 5,477,033 | A | 12/1995 | Bergholtz | 219/549 |
| 5,497,883 | A | 3/1996 | Monetti | 206/545 |
| 5,500,667 | A | 3/1996 | Schwiebert et al. | 347/102 |
| 5,520,102 | A | 5/1996 | Monetti | 99/483 |
| 5,521,357 | A | 5/1996 | Lock et al. | 219/543 |
| 5,571,435 | A | 11/1996 | Needham | 219/544 |
| 5,572,290 | A | 11/1996 | Ueno et al. | 399/329 |
| 5,581,289 | A | 12/1996 | Firl et al. | 347/104 |
| 5,582,754 | A | 12/1996 | Smith et al. | 219/438 |
| 5,586,214 | A | 12/1996 | Eckman | 392/503 |
| 5,618,065 | A | 4/1997 | Akiyama | 285/21.2 |
| 5,619,240 | A | 4/1997 | Pong et al. | 347/103 |
| 5,625,398 | A | 4/1997 | Milkovits et al. | 347/104 |
| 5,633,668 | A | 5/1997 | Schwiebert et al. | 347/102 |
| 5,691,756 | A | 11/1997 | Rise et al. | 347/102 |
| 5,697,143 | A | 12/1997 | Barfield | 29/611 |
| 5,703,998 | A | 12/1997 | Eckman | 392/340 |
| 5,708,251 | A | 1/1998 | Naveh | 219/121.66 |
| 5,714,738 | A | 2/1998 | Hauschulz et al. | 219/535 |
| 5,779,870 | A | 7/1998 | Seip | 205/77 |
| 5,780,817 | A | 7/1998 | Eckman et al. | 219/458 |
| 5,780,820 | A | 7/1998 | Komyoji et al. | 219/543 |
| 5,781,412 | A | 7/1998 | De Sorgo | 361/704 |
| 5,806,177 | A | 9/1998 | Hosomi et al. | 29/846 |
| 5,811,769 | A | 9/1998 | Schiffmann et al. | 219/762 |
| 5,822,675 | A | 10/1998 | Paquet et al. | 428/561 |
| 5,824,996 | A | 10/1998 | Kochman et al. | 219/529 |
| 5,829,171 | A | 11/1998 | Weber et al. | 36/93 |
| 5,835,679 | A | 11/1998 | Eckman et al. | 392/585 |
| 5,856,650 | A | 1/1999 | Rise et al. | 219/216 |
| 5,902,518 | A | 5/1999 | Khazai et al. | 252/511 |
| 5,930,459 | A | 7/1999 | Eckman | 392/503 |
| 5,940,895 | A | 8/1999 | Wilson et al. | 4/237 |
| 5,947,012 | A | 9/1999 | Ewald et al. | 99/374 |
| 5,954,977 | A | 9/1999 | Miller et al. | 219/201 |
| 5,961,869 | A | 10/1999 | Irgens | 219/549 |
| 6,056,157 | A | 5/2000 | Gehl et al. | 222/94 |
| 6,089,406 | A | 7/2000 | Feldner | 222/103 |
| 6,137,098 | A | 10/2000 | Moseley et al. | 219/727 |
| 6,147,332 | A | 11/2000 | Holmberg et al. | 219/526 |
| 6,147,335 | A | 11/2000 | Von Arx et al. | 219/544 |
| 6,150,635 | A | 11/2000 | Hannon et al. | 219/386 |

OTHER PUBLICATIONS

"Flexibility and cost Savings with Rope Elements", Heating Engineers, Inc. Aug. 1998.

Desloge Engineering Col, Letter to Lou Steinhauser dated Feb. 19, 1997.

Immersion Heaters Oil and Water, p. 11 (19_)v.

Special Purpose Flange Heaters, p. 58 (19_).

Lakewood Trade Literature entitled "Oil–Filled Radiator Heater" (19_).

Encon Drawing Part Nos. 02–06–480 & 02–06–481 (19_).

Encon Drawing No. 500765 (Jun. 10, 1987).

Vulcan Electric Company Trade Literature entitled "Bushing Immersion Heaters", 1983.

Trade Literature "Euro–Burner Solid Disc Converson Burners" Energy Convertors, Inc., Dallas, PA 1991.

"Polymers," *Guide to Selecting Engineering Materials*, a special issue of Advanced Materials& Presses, Metals Park, OH, ASM International, 1990, pp. 32–33.

Machine Design, "Basics of Design Engineering" Jun. 1991, 429–432, 551, 882–884.

Machine Design, "Basics of Design Engineering", Jun. 1994, pp 624–631.

Machine Design, May 18, 2000, 3 pages.

Carvill, Wm. T., "Prepreg Resins", Enginerred Materials Handbook, vol. 1, Composites pp. 139–142.

Thermoplastic Polyimide (TPI) Features, RTP Company's 4200 series compounds (4 pages).

World Headquarters, RTP Co, RTP 1300 Series Polyphenylene Sulfide Compounds, 1 page.

World Headquarters, RTP Co, RTP 2100 Series Polyetherimide Compounds, 1 page.

World Headquarters, RTP Co, RTP 3400 Series Liquid Crystal Polymer Compounds, 1 page.

World Headquarters, RTP Co, RTP 4200 Series Thermoplastic Polyimide Compounds, 1 page.

Wittenberg, "Pin Shorting Contact," Western Electric Technical Digest No. 60, Oct. 1980, p. 25.

Internationl Search Report, Aug. 8, 2000.

Kronenberg, K.J., "Magnetic Water Treatment De–Mystified", Green Country Environmental Associates, LLC, pp 1–8.

* cited by examiner

FLEXIBLE SPIRALLY SHAPED HEATING ELEMENT

CROSS-REFERENCE TO RELATED APPLICATIONS

The present application is related to U.S. application Ser. No. 09/275,161 filed Mar. 24, 1999, which is a continuation in part of U.S. application Ser. No. 08/767,156 filed on Dec. 16, 1996, now U.S. Pat. No. 5,930,459, issued on Jul. 27, 1999, which in turn is a continuation in part of U.S. application Ser. No. 365,920, filed Dec. 29, 1994, now U.S. Pat. No. 5,586,214, issued on Dec. 17, 1996, which are all hereby incorporated by reference.

This application is also related to U.S. application Ser. No. 09/309,429, filed May 11, 1999, U.S. application Ser. No. 09/369,779, filed Aug. 6, 1999, and U.S. application Ser. No. 09/416,371, filed Oct. 13, 1999, which are also hereby incorporated by reference.

FIELD OF THE INVENTION

This invention relates to electric resistance heating elements, and more particularly, to plastic insulated resistance heating elements containing encapsulated resistance material.

BACKGROUND OF THE INVENTION

Electric resistance heating elements composed of polymeric materials are quickly developing as a substitute for conventional or "standard" metal sheathed heating elements, such as those containing a Ni—Cr coil disposed axially through a U-shaped tubular metal sheath. Good examples of polymeric heating elements include those disclosed in Eckman et al., U.S. Pat. No. 5,586,214, issued Dec. 17, 1996; Lock et al., U.S. Pat. No. 5,521,357, issued May 28, 1996; Welsby et al., U.S. Pat. No. 4,326,121, issued Apr. 20, 1982, and J. W. Welsh, U.S. Pat. No. 3,621,566, issued Nov. 23, 1971, which are all hereby incorporated herein by reference.

Eckman et al. '214 discloses a polymer encapsulated resistance heating element including a resistance heating member encapsulated within an integral layer of an electrically-insulating, thermally-conductive polymeric material. The disclosed heating elements are capable of generating at least about 1,000 watts for heating fluids such as water and gas.

Lock et al. '357 discloses a heater apparatus including a resistive film formed on a substrate. The first and second electrodes are coupled to conductive leads which are electrically connected to the resistive film. The heater also includes an over molded body made of an insulating material, such as a plastic. Lock et al. '357 further disclose that their resistive film can be applied to a substrate, such as a printed circuit board material.

Welsby et al. '121 discloses an electric immersion heater having a planar construction which contains an electrical resistance heating wire shrouded within an integral layer of polymeric material, such as PFA or PTFE, which is wound around end portions of a rectangular frame. The frame and wound resistance wire is then secured in spaced relationship with one or more wrapped frame members, and then further protected by polymeric cover plates which allow for the free flow of fluid through the heater.

J. W. Welsh '566 discloses a single planar resistance member having a dipped coating of thermoplastic material, such as PTFE, nylon or KEL-F, a 3M product. Welsh teaches that his element can be self-cleaning, since the heated wire is free to expand within the insulation, which is flexible.

The problems associated with metal sheathed elements in immersed fluids are generally known. These problems are caused by the industry's need for high watt densities. High watt densities can cause high external sheath temperatures which can damage fluid and increase scale build-up, and high internal heating element temperatures which limit heater life.

The formation of hard lime scale on container walls and heating elements can be traced to the calcium carbonate ($CaCO_3$) content of the water in combination with the scarcity of nucleation centers in ordinary water. When the concentration of the calcium carbonate exceeds its solubility, solidification often begins on the surface of the heating element. Hard lime scale begins with a few starting points on the surface of the element which attach firmly to it and extend crystals which cling to one another in a dendritic crystallization mode. This process continues as further solidification of the mineral occurs, growing layer by layer over each successive formation of dendrites. See Kronenberg, "Magnetic Water Treatment De-mystified", Green Country Environmental Associates, LLC, Jan. 19, 2000, which is hereby incorporated by reference.

Scale produced by residential water heaters operated on hard water at approximately 160° F. consists principally of calcium and calcium carbonate. Differences in water quality at various sites do not generally exert a strong influence on scale composition. Minor metallic constituents, such as magnesium, aluminum and iron, generally comprise less than 3% of the scale composition.

There is a slight improvement in scale resistance associated with polymer sheathed fluid heating elements; however, there remains a need in the heating element industry to improve this technology. Some of these weaknesses associated with polymer heating elements are known to include (1) the low thermal conductivity of polymeric coatings which generally prevents thick polymer coatings from being used; (2) the need to use a greater surface area to keep the polymer below its heat deflection temperature, while providing for the application's heating requirements; (3) the high manufacturing costs associated with larger surface area heaters, and (4) the management of mechanical and creep stresses due to the differences in the coefficient of thermal expansion between metallic and polymeric materials.

SUMMARY OF THE INVENTION

The present invention provides flexible spirally shaped heating elements comprising a resistance heating material having a plurality of spiral forms distributed around a central axis, said resistance heating material containing an electrically insulating polymeric coating. This heating element has a flux or watt density which is significantly lower than that for a tubular Heating Element of substantially similar Active Element Volume ($in^3$), but having the same or greater overall wattage rating (total watts) that the Tubular Heating Element.

In another preferred embodiment of this invention, a flexible spiral shaped heating element is provided which includes a resistance heating ribbon or wire insulated within a thermally conductive, electrically insulating polymeric coating. The resistance heating ribbon or wire is disposed into a spiral form having an external dimension sufficient to fit within a 1.0–1.5 inch opening of a standard residential hot water heater, yet provides an "effective heating surface area" (herein defined) which is at least two times greater than the effective heating surface area of a conventional metal-sheathed tubular heating element of roughly the same external dimensions.

More preferably, the spirally shaped heating elements of this invention include a surface area of about 5–60 $in^2/in^3$, and preferably about 10–30 $in^2/in^3$, which represents a great deal of improvement over Welsh '566, which presents an effective heating surface area of only about 2 $in^2/in^3$, and Welsby et al., which presents a slightly greater surface area, but is incapable of being retrofitted within an existing 1.0–1.5 inch standard opening in a hot water heater.

Moreover, the ability for the present spirally shaped heating elements to expand and contract during heating presents a tremendous opportunity to reduce scaling of hard water deposits. The elements of the present invention are capable of developing changes in their radius of curvature, which are approximately 2–10 times greater than the minimal expansion associated with the flat ribbon of Welsh, and provide even greater expansion opportunities when compared to fixed coated wire elements, such as those described by Welsby et al, which are constrained by a frame.

The claimed heating elements, in the presence of water, can run at watt densities (or flux) of less than 20 watts per square inch, and desirably about 5–15 $w/in^2$, with a target of about 7–12 $w/in^2$. It is generally known that a lower watt density will reduce fluid damage and minimize scale generation.

The preferred spirally shaped heating elements of this invention can yield watt densities of less than 50%, and preferably about 10% to about 30% of the watt density of a standard Tubular Heater Element having the same Active Element Volume ($in^3$). These heating elements minimize fluid damage, such as in the case of oil in engine block heaters or space heaters, for example, by minimizing the carbonization created by high heater surface temperatures. The elements and methods of fabrication provide a low cost heater with a minimum number of components and electrical connections.

Other improvements provided by this invention include its relatively low flux or watt density, therefore creating very low element surface and internal temperatures in immersed fluid heating applications. The polymer coatings of this invention can be provided in thicknesses of about 1–20 thousandths of an inch to provide a very low temperature differential between the resistance heating element material and the surface of the polymer coating. These flexible spirally shaped heating elements are also free to expand and contract with changes in the temperature of the heating element. This reduces mechanical stresses due to differences in the coefficient of thermal expansion between the various metallic and nonmetallic components of such heaters. The flexing also helps to break up and shed any built up scale on the heater surface. These preferred embodiments also permit nearly the entire surface area, or at least about 90–95% of the surface area of the heating element to be heated. This prevents discontinuities, or abrupt changes in the flux density of the heater surface, thereby minimizing mechanical stresses due to unheated areas in the preferred polymeric insulating coating.

The spirals of this invention, depending on the rigidity of the resistance wire, may be supported on a rod, with or without physical attachment to the rod, such as by pins, rivets or adhesive. They may be sealed or partially contained within a fluid-soluble coating or band, which dissolves quickly to permit the element to expand to its operational dimensions, which dimensions can be larger in diameter than the typical 1–1.5" diameter standard water heater tank opening, or any other standard opening desired.

A BRIEF DESCRIPTION OF THE DRAWINGS

The accompanying drawings illustrate preferred embodiments of the invention, as well as other information pertinent to the disclosure, in which.

DETAILED DESCRIPTION OF THE INVENTION

Figure 1:
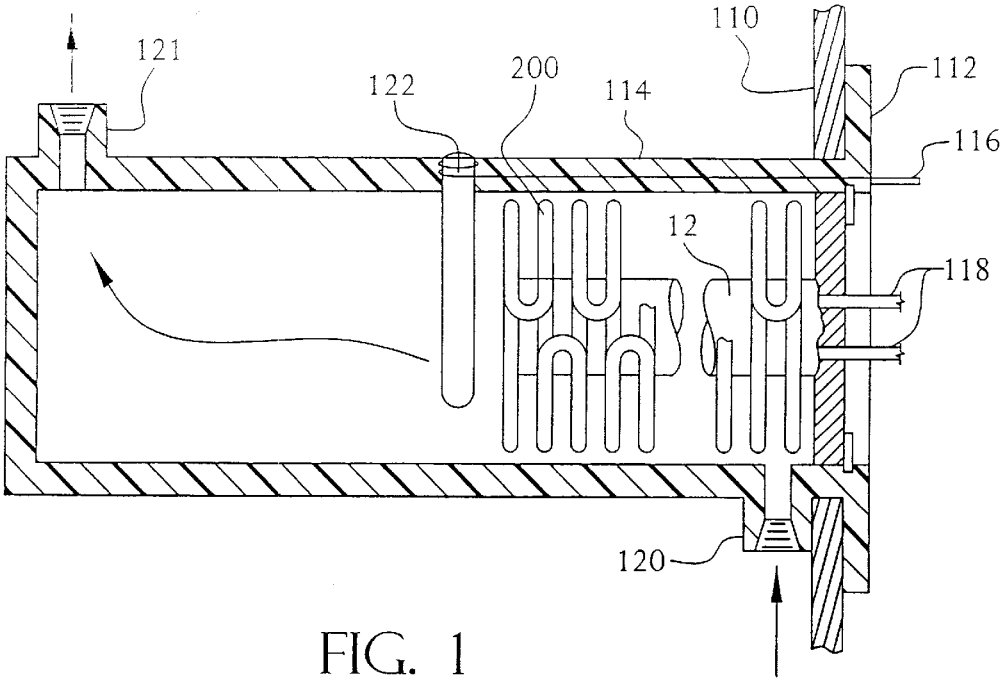
FIG. 1 is a side, cross-sectional view of a preferred heating element embodiment of this invention, including an optional element container.

The present invention provides polymeric heating elements useful in all sorts of heating environments, especially those for heating liquids in industrial and commercial applications, including pools and spas, food service (including food warmers, cheese and hot fudge dispensers and cooking surfaces and devices), water heaters, plating heaters, oil-containing space heaters, and medical devices. The disclosed heating elements can serve as replaceable heating elements for hot water service, including hot water storage capacities of 5–500 gallons, point of use hot water heaters, and retrofit applications. They can be used for instant-on type heaters, especially with the disclosed element container. As used herein, the following terms are defined:

"Additives" means any substance added to another substance, usually to improve properties, such as, plasticizers, initiators, light stabilizers, fiber or mineral reinforcements, fillers and flame retardants.

"Composite Material" means any combination of two or more materials (reinforcing elements, fillers, and composite matrix binder), differing in form or composition on a macro scale. The constituents retain their identities: that is, they do not dissolve or merge completely into one another although they act in concert. Normally, the components can be physically identified and exhibit an interface between one another.

"Spiral" means one or more looped or continuous forms of any geometric shape, including rectangular and circular, moving around a fixed point or axis; multiple spirals need not be centered on the same point or axis; a spiral can include, for example, a coil of wire located substantially in a single plane, a springlike structure having a longitudinal axis, or a series of coils connected by "u" shaped bends.

"Spirally" means shaped like a spiral.

"Coefficient of Thermal Conductivity" means the property of a material to conduct thermal energy (also known as "K-value"); it is typically measured in w/m-° C.

"Flux" means the heat flow (W or watts) per unit area ($in^2$ or $m^2$) of a heating element; it is also referred to as the Heat Flux or Watt Density of a heating element.

"Scale" means the deposits of Ca or $CaCO_3$, along with trace amounts of other minerals and oxides, formed, usually, in layers, on surfaces exposed to water storage (especially heated water).

"Effective Relative Heated Surface Area" ($in^2/in^3$) means the area of heating element exposed to the solid, liquid or gas to be heated, excluding internal or unexposed surfaces, ("Effective Surface Area", $in^2$ )over the volume of heating element immersed in the material or fluid ("Active Element Volume", $in^3$), excluding flanges or wiring outside of said material or fluid which may make up part of the element.

"Integral Composite Structure" means a composite structure in which several structural elements, which would conventionally be assembled together by mechanical fasteners after separate fabrication, are instead adhered together, melt bonded, or laid up and cured, to form a single, complex, continuous structure. All or some of the assembly may be co-cured, or joined by heat, pressure or adhesive.

"Reinforced Plastic" means molded, formed, filament-wound, tape-wrapped, or shaped plastic parts consisting of resins to which reinforcing fibers, mats, fabrics, mineral reinforcements, fillers, and other ingredients (referred to as "Reinforcements") have been added before the forming operation to provide some strength properties greatly superior to those of the base resin.

"Tubular Heating Element" means a resistance heating element having a resistance heating wire surrounded by a ceramic insulator and shielded within a plastic, steel and/or copper-based tubular sleeve, as described in, for example, U.S. Pat. No. 4,152,578, issued May 1, 1979, and hereby incorporated by reference.

Other terms will be defined in the context of the following specification.

Element Construction

With reference to the drawings, and in particular to FIGS. 1–4 thereof, there is shown a preferred flexible spirally shaped heating element 200 including a resistance heating material 18 having an electrically insulating coating 16 thereon. The coated resistance heating material 10 is desirably shaped into a configuration which allows substantial expansion during heating of the element. More preferably, this substantial expansion is created through a series of connected, spirally shaped forms such as those disclosed in the spirally shaped heating elements 100, 200 and 300. Due to their length and non-constricting nature, such spirally shaped forms have the ability to expand and contract at a rate which is greater than a shorter, confined flat sinus member, such as that described by Welsh '566, or a wire which is fixed on a stamped metal plate, as shown by Welsby et al. '121. The preferred flexible spirally shaped heating elements 100 and 200 of this invention preferably are self-supporting, but can be wound around a central axis 14 of a core 12 and terminate in a pair of power leads 118 or 11. The core 12 desirably is of an insulating material, such as wood, ceramic, glass or polymer, although it can be of metallic construction if made part of the resistance heating function, or if the resistance heating material is coated in a polymer, glass or ceramic such as described in the preferred embodiments of this invention.

The power leads 11 and 118 are desirably terminated in a conventional manner such as by compression fittings, terminal end pieces or soldering. Plastic-insulated cold pins can also be employed.

The preferred heating element construction of this invention can be disposed within an element container 114, preferably including a molded polymeric material such as, polyethylene, polystyrene, PPS or polycarbonate. The element container 114 preferably allows enough room for the spirally shaped heating element 100, 200 or 300 to expand without constriction. The element also can optionally include a temperature or current sensing device 122, such as a circuit breaker, thermostat, RTD, solid state temperature sensor, or thermocouple. The temperature or current sensing device 122 can be disposed within the insulating coating 16, in the wall of the element container 114, in the core 12, or disposed in close proximity to the heating element 100, 200 or 300.

When an element container 114 is employed, it is desirable that the container have one or more openings, such as liquid inlet and outlets, 120 and 121. This permits the cold water to enter in the liquid inlet 120, and hot water to exit the liquid outlet 121. Alternatively, such a device can act independently of a water storage tank, as in for example, a point of use hot water dispenser or oil preheater, whereby fluid pipes are connected to the liquid inlets and outlets 120 and 121.

Figure 3:
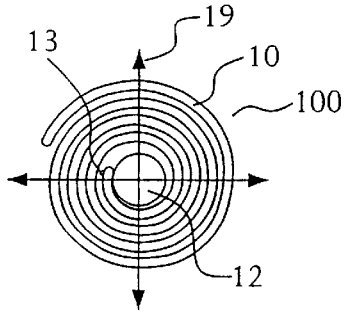
FIG. 3 is a side, elevational view of the spirally shaped heating element of FIG. 2.
Figure 5:
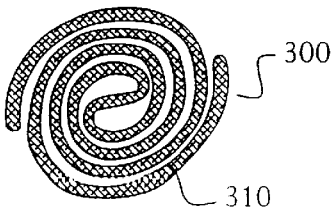
FIG. 5 is a side, elevational view of an alternative shaped heating element without a central core.
Figure 4:
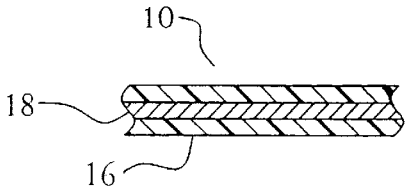
FIG. 4 is a partial, cross-sectional view, taken through line 4—4 of FIG. 2, showing a preferred construction of the heating element.

As shown in FIG. 3, the spirally shaped heating element of this invention can include a pair of axes of thermal expansion 17 and 19. Desirably, the spirally shaped heating element 100, 200 or 300 can expand at least about 1%, and more desirably, about 5–100% along such axes 17–19, as it unwinds and opens, to relieve mechanical stresses and improve descaling.

As shown in the preferred embodiments, FIGS. 2–5, the spirally shaped heating elements 100, 200 and 300 of this invention can include multiple connected spirals of coated resistance material 10 or 310 arranged along a common center line.

Figure 2:
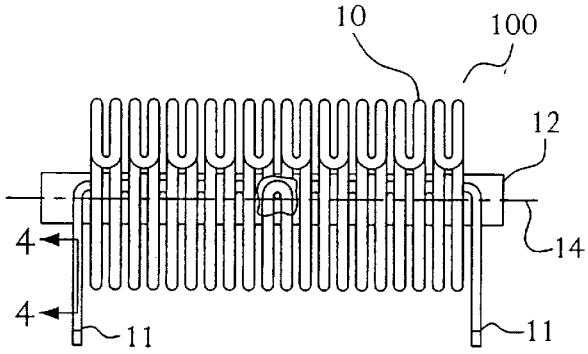
FIG. 2 is a top, plan view of an alternative spirally shaped heating element of this invention.

In the element 100 of FIGS. 2 and 3, the first pair of spirals is connected by a 180° turn of wire connecting the outer or inner ends of the first spiral. The third consecutive spiral is connected to the second spiral with a 180° turn of wire at the opposite end of the second spiral from the connection formed between the first and second spiral. This pattern is continued for the remaining spirals, alternating the 180° turn of wire connections between inter and outer ends of each spiral. These 180° turn connections are formed during the winding of the element which can be accomplished on a fixture having a plurality of pins for enabling the coated resistance heating material 10 to be wound and plastically deformed into a set spiral shape. The unconnected ends of the first and last spiral are connected to electrical leads (not shown). The individual spirals can be oval, rectangular or oddly shaped and, depending on the rigidity of the resistance wire or ribbon employed, may be supported without a core 12, as in element 300 of FIG. 5, and with or without an inner 180° turn. Optionally, the inner 180° turn can be fixed to the rod 12 by a pin 13 as shown in FIG. 3, or alternatively, by adhesive bond, weld, ultrasonic or solder joint.

The resistance heating material 18 may be a metal alloy or conductive coating or polymer, and may have a positive temperature coefficient of resistance for limiting heat or power in the case of overheating. The resistance heating material 18 may or may not be insulated within an insulating coating 16, depending upon the requirements for electrical insulation and the medium used or required application. The resistance heating material 18 of this invention may have a round, flat or other cross-sectional shape and may be solid or in powder form, and may be made of more than one alloy with different thermal expansion rates to increase the expansion or contraction of the spirally shaped heating elements 100 or 200 of this invention, with resulting improvements in the shedding of scale. Such bimetallic wire, having a longitudinal seam, is often used in residential thermostats, for example.

The spirally shaped heating elements 100, 200 or 300 of this invention may be formed with a wire or ribbon which is precoated with a polymer, thermoplastic or thermosetting resin before winding, or the wire may be wound with uncoated wire or ribbon, and then coated with a polymer by spray coating, dip coating, electrical coating, fluidized bed coating, electrostatic spraying, etc. The disclosed cores 12 may form a portion of the heating element or may be used merely to form its shape prior to disposing the core 12.

The spirally shaped heating elements of this invention, when used for residential water heating applications, are preferably designed to fit within a 1–1.5 in. diameter standard tank opening of typical hot water heaters. They are designed to have an "effective relative heated surface area" of about 5–60 $in^2/in^3$, desirably about 10–30 $in^2/in^3$.

The flexible, spiral shaped heating elements 100, 200 and 300 of this invention preferably include a resistance metal in ribbon or wire form and about 30–10 gauge sizes, preferably about 16–20 gauge, with coating thickness of about 0.001–0.020 inches, preferably about 0.005–0.012 inches. Desirable element examples have used 20 gauge Ni—Cr wire having a PFA coating of approximately 0.009 inches, resulting in an effective relative heated surface area of approximately 28 $in^2/in^3$, and sized to fit within a 1–1.5 inch diameter opening of a typical water heater.

The preferred coated or uncoated resistance wire or ribbon should be stiff enough to support itself, either alone or on a supporting carrier or core 12. The core 12 of this invention can be rod-like, rectangular, or contain a series of supporting rods or pins, such as a locating pin 13. A carrier, not illustrated, would be a metal or polymer bonded to, coextruded with, or coated over, the resistance heating material 18. The stiffness of the electrical resistance ribbon or wire can be achieved by gauge size, work hardening or by the selection of alloy combinations or conductive or non-conductive polymeric materials which are desirably self-supporting. This allows the spirally shaped heating element 100, 200 or 300 to provide differences in the radius of curvature during heating, and a much greater effective relative heated surface area than conventional tubular heaters (about 5 $in^2/in^3$) or cartridge heaters (about 4 $in^2/in^3$).

In further embodiments of this invention, the spirally shaped heating element 100, 200 or 300 can be constructed in a narrow diameter of approximately 1–6 in. which is thereafter expandable to about 2–30 inches, for example, after it is introduced through the side wall of a tank or container. This can be accomplished by retaining the spirally shaped heating element within a water soluble coating, band or adhesive, such as starch or cellulose, which is dissolved upon heating or by direct contact by a liquid, such as water. Alternatively, a low melting temperature coating, band, or adhesive, can be used, such as a 0.005–0.010 application of polyethylene or wax, for example.

Upon replacement of such spirally shaped heating elements, the flange 12, and any associated fasteners (not shown), can be removed with the coated or uncoated resistance heating material 10 being pulled through the 1–6 in. standard diameter opening. In the instance where a element container 114 is not employed, the spirally shaped heating element 100 can be removed through small openings by bending and deforming the individual spirals. Damage to the heating element at this point is not of any consequence, since the element will be discarded anyway.

General Elements Materials

The preferred electrical resistance heating material 18 contains a material which generates heat when subjected to electric current. It can be coated by an insulating coating 16, or left uncoated. Such materials are usually inefficient conductors of electricity since their generation of resistance heat is usually the result of high impedance. The preferred electrical resistance material can be fashioned into at least 2–1000 spirals. The resistance heating material can take the form of a wire, braid, mesh, ribbon, foil, film or printed circuit, such as a photolithographic film, electrodeposition, tape, or one of a number of powdered conducting or semi-conducting metals, polymers, graphite, or carbon, or one of these materials deposited onto a spiral carrier surface, which could be a polymer, metal or other fluid-resistant surface. Conductive inks can be deposited, for example, by an ink jet printer onto a flexible substrate of another material, such as plastic. Preferably, if a wire or ribbon is used, the resistance heating wire 18 or ribbon contains a Ni—Cr alloy, although certain copper, steel, and stainless-steel alloys, or even conductive and semi-conductive polymers can be used. Additionally, shape memory alloys, such as Nitinol® (Ni—Ti alloy) and Cu—Be alloys, can be used for carriers for the spirals.

The resistance heating wire 18 can be provided in separate parallel paths, for example, a pair of wires or ribbons, separated by an insulating layer, such as polymer, or in separate layers of different resistance materials or lengths of the same material, to provide multiple wattage ratings. Whatever material is selected, it should be electrically conductive, and heat resistant.

Since it is desirable for the electrical resistance material 18 to be in a spiral form that is capable of expanding and contracting when heated or energized, a minimum gauge of 30 g is desirable, preferably about 30–10 g and more preferably about 20–16 g, not including the insulating coating 16. In practice, it is expected that the electrical resistance material 18, in the preferred wire or ribbon form, be wound into at least one curved form or continuously bending line, such as a spiral, which has at least one free end or portion which can expand or contract at least 0.5–5 mm, and preferably at least about 5–10% of its original outer dimension. In the preferred embodiment, this free end portion is a 180° looped end, shown in FIGS. 1 and 2. Alternatively, said expansion and contraction should be sufficient to assist in descaling some of the mineral deposits which are known to build up onto electrical resistance heating elements in liquid heating applications, especially in hot water service. Such mineral deposits can include, for example, calcium, calcium-carbonate, iron oxide, and other deposits which are known to build up in layers over time, requiring more and more current to produce the same watt density, which eventually results in element failure.

The insulating coating 16, if employed, is preferably polymeric, but can alternatively contain any heat resistant, thermally conductive and preferably non-electrically conductive material, such as ceramics, clays, glasses, and semi-conductive materials, such as gallium arsenide or silicon. Additionally, cast, plated, sputter-coated, or wrought metals, such as aluminum, copper, brass, zinc and tin, or combinations thereof, could be used, if the resistance wire or material is insulated in a coating such as glass, ceramic, or high temperature polymer, or if electrical shorting is not an issue, such as in connection with the heating of dry materials or non-flammable gases, such as air.

The preferred insulating coating 16 of this invention is made from a high-temperature polymeric resin including a melting or degradation temperature of greater than 93° C. (200° F.). High temperature polymers known to resist deformation and melting at operating temperatures of about 75–85° C. are particularly useful for this purpose. Both thermoplastics and thermosetting polymers can be used. Preferred thermoplastic materials include, for example: fluorocarbons (such as PTFE, ETFE, PFA, FEP, CTFE, ECTFE, PVDF, PVF, and copolymers thereof), polypropylene, nylon, polycarbonate, polyetherimide, polyether sulfone, polyaryl-sulfones, polyimides, and polyetheretherketones, polyphenylene sulfides, polyether sulfones, and mixtures and co-polymers of these thermoplastics. Preferred thermosetting polymers include epoxies, phenolics, and silicones. Liquid-crystal polymers can also be employed for improving high-temperature use, such as for example, RTP 3400–350MG liquid crystal polymer from RTP Company, Winona, MN. Also useful for the purposes of this invention are bulk molding compounds ("BMCs"), prepregs, or sheet molding compounds ("SMCs") of epoxy reinforced with about 5–80 wt % glass fiber. A variety of commercial epoxies are available which are based on phenol, bisphenol, aromatic diacids, aromatic polyamines and others, for example, Lytex 930, available from Quantum Composites, Midland, Mich. Conductive plastics, such as RTP 1399X86590B conductive PPS thermoplastic, could also be used, with or without a further resistance heating material, such as those described above. Applicant has found a thin layer, about 0.005–0.012 in of PFA to be most desirable for this invention. Tests have shown that the thin polymer coatings and high Effective Relative Heated Surface Area of these elements arrests scale development by increasing the water solubility of Ca and $CaCo_3$ proximate to the element, providing greater element life.

It is further understood that, although thermoplastic resins are desirable for the purposes of this invention, because they are generally heat-flowable, some thermoplastics, notably polytetraflouroethylene (PTFE) and ultra high-molecular-weight polyethylene (UHMWPE) do not flow under heat alone. Also, many thermoplastics are capable of flowing without heat, under mechanical pressure only. On the other hand, thermosetting polymers are usually heat-settable, yet many thermosetting plastics such as silicone, epoxy and polyester, can be set without being heated. Another thermosetting material, phenolic, must first be made to flow under heat, like a thermoplastic, before it can be heat-set. For the most part, however, thermosetts are known to cross-link and thermoplastics do not.

As stated above, the insulating coating 16 of this invention preferably also includes reinforcing fibers, such as glass, carbon, aramid (Kevlar®), steel, boron, silicon carbide, polyethylene, polyamide, or graphite fibers. Glass reinforcement can further improve the maximum service temperature of the insulating coating 16 for no-load applications by about 50° F. The fibers can be disposed throughout the polymeric material in amounts of about 5–75 wt % prior to, or after coating or forming the final heating elements 100 or 200, and can be provided in single filament, multi-filament thread, yarn, roving, non-woven or woven fabric. Porous substrates, discussed further below, such as ceramic and glass wafers can also be used with good effect.

In addition to reinforcing fibers, the insulating coating 16 may contain thermally conducting, preferably non-electrically conducting, additives in amounts of about 5–80 wt %. The thermally-conducting additives desirably include ceramic powder such as, for example, $Al_2O_3$, MgO, $ZrO_2$, Boron nitride, silicon nitride, $Y_2O_3$, SiC, $SiO_2$, $TiO_2$, etc., or a thermoplastic or thermosetting polymer which is more thermally conductive than the polymer matrix of the insulating coating 16. For example, small amounts of liquid-crystal polymer or polyphenylene sulfide particles can be added to a less expensive base polymer such as epoxy or polyvinyl chloride, to improve thermal conductivity. Alternatively copolymers, alloys, blends, and interpenetrating polymer networks (IPNs) could be employed for providing improved thermal conductivity, better resistance to heat cycles and creep.

In view of the foregoing, it can be realized that this invention provides flexible, spirally shaped heating elements which provide a greatly improved effective relative heated surface area, a higher degree of flexing to remove scale, and much lower watt densities for minimizing fluid damage and avoiding scale build up. The heating elements of this invention can be used for hot water storage applications, food service and fuel and oil heating applications, consumer devices such as hair dryers, curling irons etc., and in many industrial applications. Although various embodiments have been illustrated, this was for the purpose of describing, but not limiting the invention. Various modifications which will become apparent to one skilled in the art, are within the scope of this invention described in the attached claims.

What is claimed:

1. A method of manufacturing a heating element comprising:

winding a first resistance heating material in a continuous spiral path having a plurality of spiral forms disposed in three dimensions along a longitudinal axis, and connected by "u" shaped bends, coating a portion of said resistance heating material with an electrically insulating, polymeric material, whereby said resulting heating element has a first radius of curvature at ambient temperature, and a second radius of curvature at 160° F., as measured on the surface of the polymer material, which is substantially greater than said first radius of curvature.

2. The method of claim 1 wherein said second radius of curvature is at least 1% greater than said first radius of curvature.

3. The method of claim 1 wherein said coating step comprises dip coating, electrostatic deposition, molding, painting, or a combination thereof.

4. The method of claim 1 wherein said coating step comprises applying a thermoplastic or thermosetting resin in a thickness of about 0.001–0.020 inches.

5. A method of manufacturing a heating element comprising:

winding a first resistance heating material in a continuous spiral path having a plurality of connected individual spiral forms disposed in three dimensions along a longitudinal axis, a plurality of said connected individual spiral forms including a plurality of partially overlapping turns, coating a portion of said resistance heating material with an electrically insulating, polymeric layer, whereby said resulting heating element has a first radius of curvature at ambient temperature, and a second radius of curvature at 160° F., as measured on the surface of the polymer material, which is substantially greater than said first radius of curvature.

6. The method of claim 5, wherein said individual spiral forms are connected to adjacent individual spiral forms by "u" shaped bends.

7. The method of claim 6, wherein said second radius of curvature is at least 1% greater than said first radius of curvature.

8. The method of claim 6, wherein said coating step comprises dip coating, electrostatic deposition, molding, painting, or a combination thereof.

9. The method of claim 6, wherein said coating step comprises applying a thermoplastic or thermosetting resin in a thickness of about 0.001–0.020 inches.

10. A heating element comprising a first resistance heating material wound in a continuous spiral path having a plurality of spiral forms disposed in three dimensions along a longitudinal axis, and connected by "u" shaped bends, at least a portion of said first resistance heating material coated with an electrically insulating, polymeric material, whereby said resulting heating element has a first radius of curvature at ambient temperature, and a second radius of curvature at 160° F., as measured on the surface of the polymer material, which is substantially greater than said first radius of curvature.

11. The heating element of claim 10, wherein the polymeric material includes a thermoplastic or thermosetting resin in a thickness of about 0.001–0.020 inches.

12. The heating element of claim 10, wherein a plurality of said spiral forms include a plurality of partially overlapping turns.

* * * * *